US006922950B2

(12) United States Patent
Heierli

(10) Patent No.: US 6,922,950 B2
(45) **Date of Patent: *Aug. 2, 2005**

(54) TOP ARCH OVERFILLED SYSTEM

(75) Inventor: Werner Heierli, Zurich (CH)

(73) Assignee: BEBOTech Corporation, Middletown, OH (US)

( * ) Notice: Subject to any disclaimer, the term of this patent is extended or adjusted under 35 U.S.C. 154(b) by 31 days.

This patent is subject to a terminal disclaimer.

(21) Appl. No.: 10/739,734

(22) Filed: Dec. 17, 2003

(65) Prior Publication Data

US 2004/0182017 A1 Sep. 23, 2004

Related U.S. Application Data

(62) Division of application No. 10/102,921, filed on Mar. 22, 2002, now Pat. No. 6,719,492.

(51) Int. Cl.[7] ..... E04B 1/32

(52) U.S. Cl. ..... 52/88; 52/86; 52/89; 52/169.1; 405/124; 405/125

(58) Field of Search ..... 52/87, 86, 263, 52/88, 89, 169.9; 405/125, 124, 134, 135, 151, 150.1, 287.1; 14/24, 69.5

(56) References Cited

U.S. PATENT DOCUMENTS

| | | | |
|---|---|---|---|
| 3,482,406 | A | 12/1969 | Schuppisser et al. |
| 3,750,407 | A | 8/1973 | Heierli et al. |
| 3,999,394 | A | 12/1976 | Eberhardt et al. |
| 4,221,502 | A | 9/1980 | Tanikawa |
| 4,300,320 | A | 11/1981 | Rooney |
| 4,390,306 | A | 6/1983 | Fisher |
| 4,458,457 | A | 7/1984 | Heierli |
| 4,490,950 | A | 1/1985 | Heierli |
| 4,537,529 | A | 8/1985 | FitzSimmons |
| 4,558,969 | A | 12/1985 | FitzSimmons |
| 4,587,684 | A | 5/1986 | Miller |
| 4,595,314 | A | 6/1986 | Lockwood |
| 4,687,371 | A | 8/1987 | Lockwood |
| 4,695,187 | A | 9/1987 | Mikhailovsky et al. |
| 4,704,754 | A | 11/1987 | Bonasso |
| 4,745,713 | A | 5/1988 | Gotoh |
| 4,797,030 | A | 1/1989 | Lockwood |
| 4,854,775 | A | 8/1989 | Lockwood |
| 4,993,872 | A | 2/1991 | Lockwood |
| 5,281,053 | A | 1/1994 | Matiere |
| 5,439,319 | A | 8/1995 | Flanagan et al. |
| 5,836,717 | A | 11/1998 | Bernini |
| D406,902 | S | 3/1999 | Lockwood |
| 6,161,342 | A | 12/2000 | Barbier et al. |
| 6,243,994 | B1 | 6/2001 | Bernini |
| 6,434,892 | B1 | 8/2002 | Heierli |
| 6,460,213 | B1 | 10/2002 | Flint et al. |
| 6,719,492 | B1 * | 4/2004 | Heierli ..... 405/124 |

FOREIGN PATENT DOCUMENTS

| | | |
|---|---|---|
| AT | 395894 B | 3/1993 |
| EP | 0393197 A | 10/1990 |
| JP | 07003826 A | 6/1995 |
| NL | 397981 B | 8/1994 |
| NL | 9300550 A | 10/1994 |

* cited by examiner

*Primary Examiner*—Carl D. Friedman
*Assistant Examiner*—Chi Q. Nguyen
(74) *Attorney, Agent, or Firm*—Thompson Hine LLP

(57) ABSTRACT

An earth overfilled arched structure includes a shallow arch spanning a clear space. The sides of the clear space are formed by curved or straight walls. Solidified zones of earth material (backfill or in situ) against the springs of the arch and/or behind the walls form foundation blocks which are in intimate contact via arch footings with the springs of the arch and/or with the upper part of the sidewalls in such a way that the arched structure delivers most or all of its support forces into the foundation blocks. These, due to their size and weight, transfer and spread the support forces to the subsoil so that displacements, especially in the horizontal directions, are minimal.

27 Claims, 9 Drawing Sheets

DIRECT TRANSFER OF THE ARCH THRUST THROUGH THE SOLIDIFIED BACKFILL MATERIAL (FOUNDATION BLOCKS) INTO THE SUBSOIL. THE FOUNDATION BLOCKS REDUCE THE LOADS IN THE SUBSOIL SUCH THAT THE OUTWARD DISPLACEMENTS OF THE ARCH SPRINGS REMAIN VERY LIMITED.

OVERFILLED ARCH STRUCTURE WITH STRAIGHT SIDE WALLS

OVERFILLED ARCH STRUCTURE WITH ARCHED SIDE WALLS

TRANSFER OF LOADS THROUGH THE SIDES TO FOOTINGS
AT THE BASE OF THE BACKFILLED/OVERFILLED STRUCTURE

DIRECT TRANSFER OF THE ARCH THRUST THROUGH THE SOLIDIFIED
BACKFILL MATERIAL (FOUNDATION BLOCKS) INTO THE SUBSOIL.
THE FOUNDATION BLOCKS REDUCE THE LOADS IN THE SUBSOIL
SUCH THAT THE OUTWARD DISPLACEMENTS OF THE ARCH
SPRINGS REMAIN VERY LIMITED.

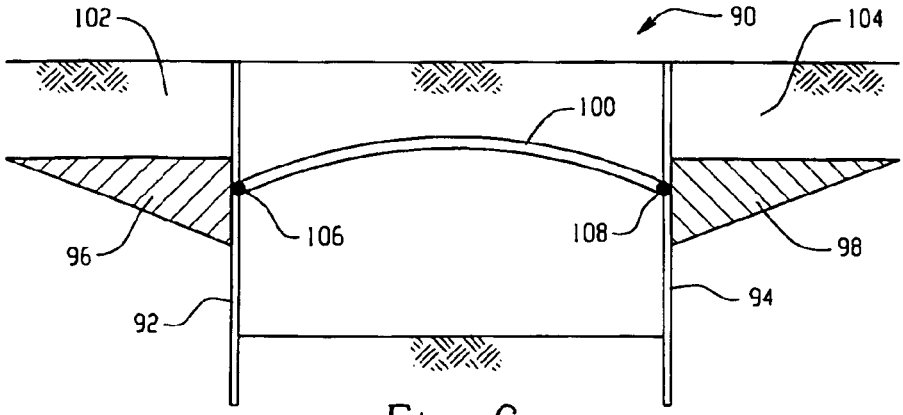
Fig. 6
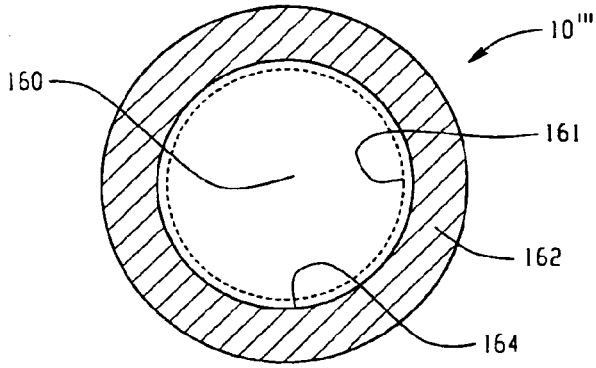
Fig. 8 (PLAN VIEW)
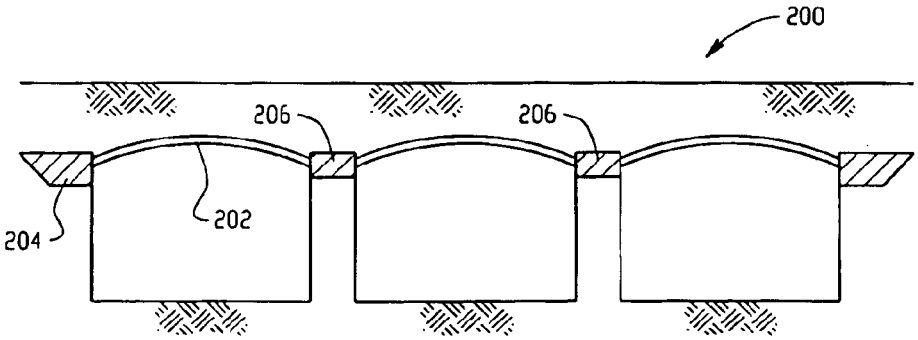
Fig. 9

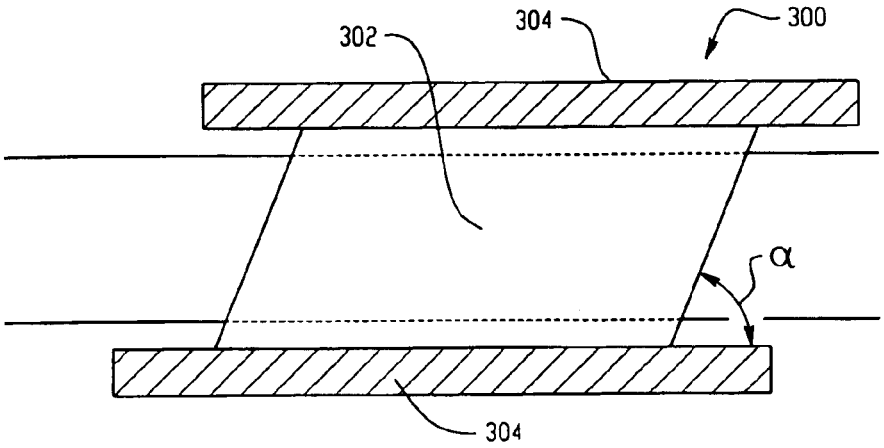
Fig. 10 (PLAN VIEW)
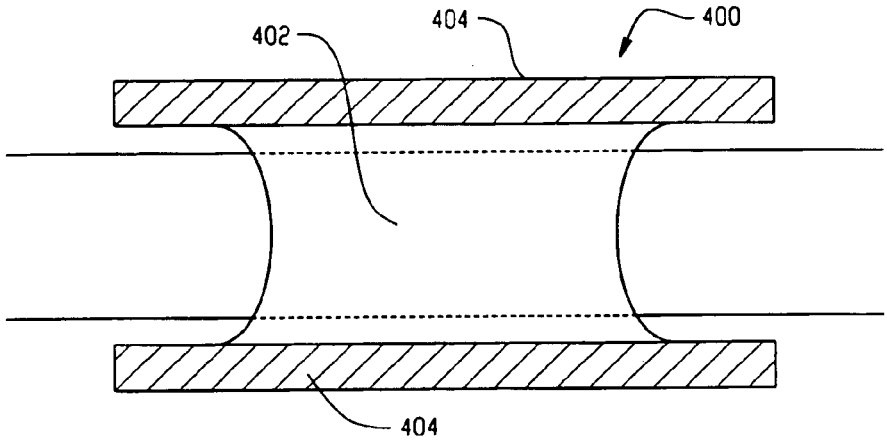
Fig. 11 (PLAN VIEW)
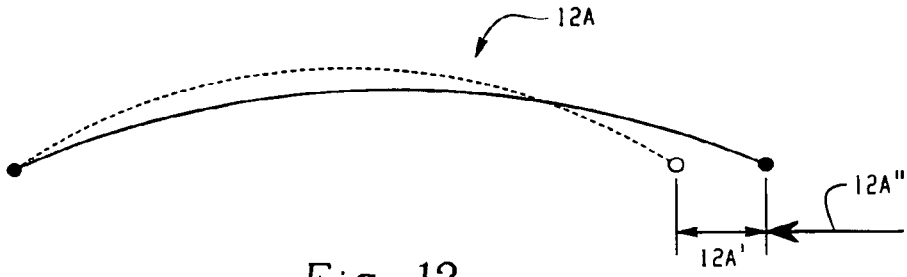
Fig. 12

TOP ARCH OVERFILLED SYSTEM

CROSS-REFERENCES

This application is a divisional application of Ser. No. 10/102,921, filed Mar. 22, 2002 now U.S. Pat. No. 6,719,492.

TECHNICAL FIELD OF THE INVENTION

The present invention relates to the general art of structural, bridge and geotechnical engineering, and to the particular field of overfilled arch and/or cut-and-cover structures.

BACKGROUND OF THE INVENTION

Frequently, overfilled arch structures formed of precast or cast-in-place reinforced concrete are used in the case of bridges to support one pathway over a second pathway, which can be a waterway, a traffic route, or in the case of other structures, a storage space or the like. The terms "overfilled arch" or "overfilled bridge" will be understood from the teaching of the present disclosure, and in general as used herein, an overfilled bridge or an overfilled arch is a bridge formed of arch elements that rest on the ground or on a foundation and has soil or the like resting thereon and thereabout to support and stabilize the structure and in the case of a bridge provide the surface of the second pathway. The arch form is generally arcuate such as cylindrical in circumferential shape, and in particular a prolate shape; however, other shapes can be used. Examples of overfilled bridges are disclosed in U.S. Pat. Nos. 3,482,406 and 4,458,457, the disclosures of which are incorporated herein by reference.

Presently, reinforced concrete overfilled arches are usually constructed by either casting the arch in place or placing precast elements, or a combination of these. These arched structures rest on prepared foundations at the bottom of both sides of the arch. The fill material, at the sides of the arch (backfill material) serves to diminish the outward displacements of the structure when the structure is loaded from above. As used herein, the term "soil" is intended to refer to the normal soil, which can be backfill or in situ, located at a site used for a bridge structure, and which would not otherwise adequately support an arch. The terms "backfill," and "in situ" will be used to mean such "soil" as well.

Soil is not mechanically strong enough to adequately support bridge structures of interest to this invention. Thus, prior art bridge structures have been constructed to transfer forces associated with the structure to walls of the structure and/or large concrete foundations at the base of the wall. Such walls have to be constructed in a manner that will support such forces and thus have special construction requirements. As will be discussed below, such requirements present drawbacks and disadvantages to such prior art structures.

For the prior art structures, the overfilled arches are normally formed such that the foundation level of the arch is at the approximate level of a lower pathway or floor surface of an underground structure over which the arch spans. Referring to FIGS. 1A–1C, it can be understood that prior art systems S1 and S2 include sides or sidewalls SW1 and SW2 which transfer loads from tops T1 and T2 of the arch to foundation F1 and F2. The sides of arch systems S1 and S2 must be sufficiently thick and contain sufficient reinforcement in order to be able to carry these loads and the thereby induced bending moments.

Furthermore, as it is necessary to limit the arch loading and bending actions in the top and sides of prior art overfilled arch systems to an acceptable level, the radius of the arch is in practice restricted. This restriction in arch radius leads to a higher "rise" R1 and R2 (vertical dimension between the top of clearance profile C1 and C2 of lower pathway surface LS1 or LS2 and crown CR1 and CR2 of the arch) in the arch profile than is often desirable for the economical and practical arrangement of the two pathways and formation of the works surrounding and covering the arch. This results in a lost height LH1 and LH2 which can be substantial in some cases.

Beams or slabs, while needing a larger thickness than arches, do not require this "rise" and, therefore, can be used for bridges accommodating a smaller height between the top of the clearance profile of the lower pathway and the top of the upper pathway. Arches, despite their economical advantage, often cannot compete with structures using beams or slabs for this reason especially for larger spans. However, the larger thickness may result in an expensive structure whose precast elements may be difficult unwieldy and heavy to transport to a building site. Thus, many of the advantages of this structure may be offset or vitiated.

Furthermore, as indicated in FIGS. 1A–1C, foundations F1 and F2 for the prior art overfilled arch systems must be substantial in order to carry the arch loading indicated in FIG. 1C as AL, and require additional excavation at the base of the arch (generally beneath the lower pathway) to enable their construction. As will be understood from the present disclosure, forces AL can be considered as being circumferential forces, and forces AV can be considered as being vertical forces with forces AH being considered as horizontal forces. Loading forces on the system are a combination of these forces.

For overfilled arches made of precast construction, the incorporation of the required height of the sides or sidewalls of the arch result either in a tall-standing precast element which is difficult and unwieldy to transport and to place or in the requirement of pedestals, such as pedestals F1*a* shown in FIG. 1A.

OBJECTS OF THE INVENTION

It is a main object of the present invention to provide an economical and expeditiously erected overfilled arch structure system and method of forming an overfilled arch structure system.

It is another object of the present invention to provide an arch structure system and method of forming an arch structure system that utilizes soil to create a foundation for the arch structure.

It is another object of the present invention to provide an arch structure and system and method of forming an arch structure and system that does not transfer forces associated with an arch element directly to walls of the arch structure and system whereby the walls are not required to support a significant amount of these forces.

It is another object of the present invention to provide an overfilled arch bridge or other structure and method of construction therefor which enables a minimal arch curvature to be adopted.

It is another object of the present invention to minimize the rise of the arch and hence extend the scope of application of the arch while still maintaining a structural arching action in the arch of the overfilled structure.

It is another object of the present invention to provide an overfilled arch bridge structure and method of construction therefor which enables the sides/sidewalls of the overfilled structure to be of a lighter and therefore more economical design and faster methods of construction as compared to the prior art.

It is another object of the present invention to provide an overfilled arch bridge structure which enables such a structure to be constructed using poor quality backfill material.

It is another object of the present invention to provide an overfilled arch bridge structure and method of construction therefor which enables the footings at the base of the overfilled structure to be smaller than the prior art.

It is another object of the present invention to provide an overfilled arch bridge structure and method of construction therefor which enables the footings at the base of the overfilled structure to be omitted.

It is another object of the present invention to provide an overfilled arch bridge structure and method of construction therefor which enables the footings at the base of the overfilled structure to be reduced to very small dimensions serving only for the erection of sidewalls.

It is another object of the present invention to provide an overfilled arched bridge and method of construction therefor which reduces dependence on large and unwieldy element transportation and reliance on heavy erection cranes as compared to the prior art.

It is another object of the present invention to provide an overfilled arched bridge which is expeditious to produce.

SUMMARY OF THE INVENTION

These, and other, objects are achieved by an arched overfilled and/or backfilled structure which includes a shallow arch spanning over a clear space. The sides of the clear space are formed by curved or planar walls. Solidified zones of the backfill material or previously existing (in situ) ground against the footings at the springs, also referred to as ends, of the arch and/or behind the walls form foundation blocks which are in intimate contact with the footings at the arch springs and/or with the upper part of the walls in such a way that the arch delivers all or at least most of its support forces into the aforementioned foundation blocks, drastically reducing the normal forces, shear forces and bending moments in the walls and wall foundations. The arch structure contacts the foundation blocks in a manner that the support forces of the arch are transferred to the foundation blocks rather than to the sidewalls of the system. The resulting advantages of transferring such forces to the foundation blocks rather than to the sidewalls will be understood from the teaching of the present disclosure.

The arched structure system which is formed using precast concrete, or cast-in-place concrete, or a combination of both comprises either:

A plain concrete or reinforced concrete arch resting on arch footings which in turn rest on foundation blocks, the latter being a solidified portion of the backfill or of in situ material located outside of the wall beneath either side of the concrete arch. The concrete arch may be precast, cast-in-place (cip) or a combination. The walls can be formed using mechanically stabilized earth (MSE) or any other type of earth retaining wall system, including but not limited to sheet piles, bored piles, diaphragm walls or an excavated cip, precast or sprayed (shotcrete) concrete wall with or without nails/anchors; or A continuous, one-piece monolithic frame whereby the top of the frame comprises an arch, and the sides of the frame consist of curved or planar walls, in which the outside surfaces of the arch and top of the walls are shaped such that the arch loads are directed into foundation blocks, the latter being solidified portions of the backfill material or in situ material, located outside the frame sidewalls.

Where precast concrete is used, adjacent precast arch spans may be structurally connected along all or part of the circumferential length.

The foundation blocks of the present invention comprise a material exhibiting sufficient stiffness and strength such that the thrust reactions of the arch can be distributed via the arch footings through the foundation block to the adjacent soil material, such that the displacements of the arch springs are within acceptable limits. Shallow arches, as in the present invention, are particularly susceptible to horizontal outward displacements of the springs. The structure of the present invention ensures that the solid foundations, which are essential for such an arch, can be provided economically.

By enabling a load transfer from the springs of the arch via the arch footings into the foundation blocks, the arch support forces do not need to be transferred into the sidewalls of the earth overfilled system. This characteristic of the system embodying the present invention enables the backfilling of the sidewalls to be combined with the construction of the foundation blocks because all or part of the solidified backfill of the sidewalls or the solidified in situ ground directly constitutes the arch foundation blocks. This also enables more efficient construction procedures to be adopted for construction of the walls, which can be made considerably lighter than prior art systems.

Furthermore, by enabling direct transfer of the arch support forces into the foundation blocks at the top of the sidewalls, it is possible to adopt a flatter arch than is possible and economic for the conventional state of the art. This is because the loads and bending moments transferred into the sidewalls of a conventional overfilled arch are significantly larger for a flatter arch than for a higher (less flat) arch. A flatter arch (smaller arch rise) has the advantage that for a given clearance beneath the sides of the arch, the lost height (see lost height LH1 and LH2 in FIGS. 1A and 1B) can be reduced, and the distance between the lower and upper paths of the overfilled arch system can be reduced, thereby increasing the scope of arch structure application. Thus, the total lost height LH1 or LH2 will be considerably reduced from those values indicated in FIGS. 1A and 1B.

The present invention also includes a cover-and-cut method of such a system.

While a bridge system is discussed herein, it is to be understood that the present invention can be applied to other systems as well without departing from the scope of the present disclosure and invention. For example, any type of underground space (including, but not limited to, shelters, warehouses, storage spaces, backfilled and overfilled, or only backfilled or built into existing in situ ground) can be within the scope of the present invention and disclosure and it is intended that the present invention as defined by the teaching of this disclosure and the claims associated therewith will cover such structures as well.

BRIEF DESCRIPTION OF THE DRAWING FIGURES

FIG. 6 shows a system produced by a cover-and-cut method.

FIG. 8 is a top plan view of an alternative form of the present invention in which the overall system includes a dome and an arcuate sidewall.

FIG. 9 illustrates a multi-arch section bridge form of the present invention.

FIG. 10 illustrates the present invention as embodied in a skewed arch bridge.

FIG. 11 illustrates the present invention incorporating a battered slope at the ends of the structure to conform with a battered (sloped) fill embankment.

FIG. 12 illustrates a method step included in the method embodying the present invention in which an arch structure is prestressed.

DETAILED DESCRIPTION OF THE PREFERRED EMBODIMENT OF THE INVENTION

Other objects, features and advantages of the invention will become apparent from a consideration of the following detailed description and the accompanying drawings.

Figure 1A:
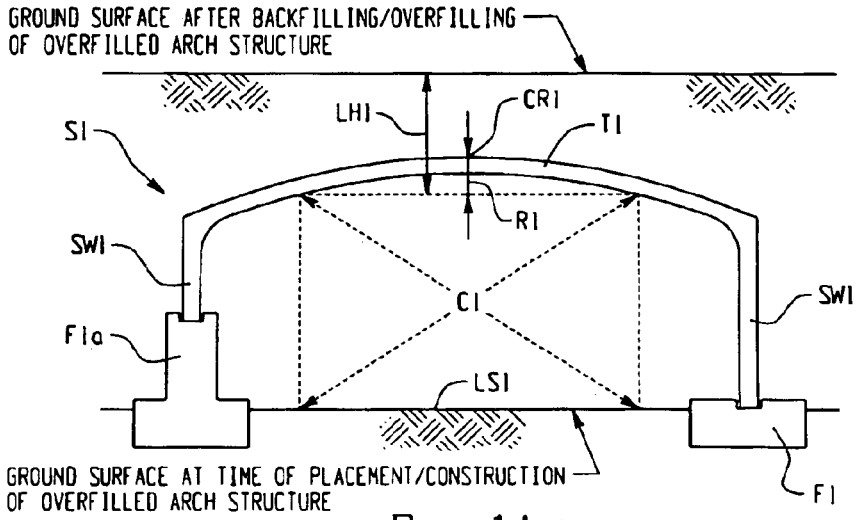
Fig. 1A (PRIOR ART)
FIGS. 1A and 1B illustrate cross sectional views of prior art systems.
Figure 1B:
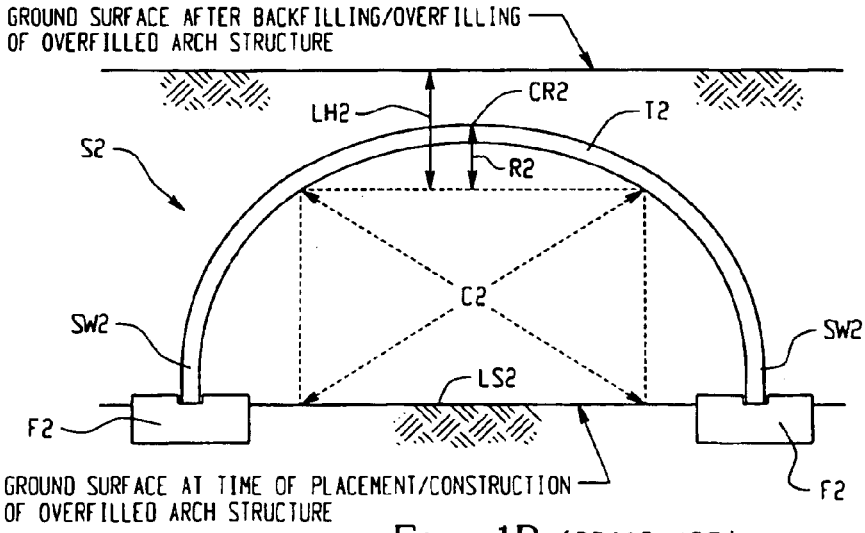
Fig. 1B (PRIOR ART)

As will be understood from the teaching of the present disclosure, instead of one footing (which may be in reinforced concrete) that distributes the horizontal and vertical support forces, the system embodying the present invention includes a small arch footing at the springs of the arch plus a large foundation block on which the arch footing rests. Thus, the stresses on the soil (ground) are distributed in two stages, which is more effective and less expensive than prior art systems. The foundation block of the present invention, while large in volume, is still relatively inexpensive because the backfill needs to be well compacted anyway, the present invention merely adds stabilizing materials. The present invention can use poor material which otherwise may be unsuitable for backfilling a normal bridge, by making it suitable through adding stabilizing materials, thus creating a foundation block. The arch of the present system contacts the thus-formed foundation blocks via the arch footings, in a manner to transfer all or at least most of the arch support forces to the foundation block. In practice, this reduces or eliminates the forces applied to the sidewall and to the wall footings thereby resulting in concomitant advantages. In most cases, the sidewalls are connected to the foundation blocks and are therefore held in place by the foundation block or blocks. The large dimensions of the foundation block together with its weight allows such an advantageous force/stress distribution, with outward (horizontal) movements/displacements of the arch ends (springs) being minimized in a very economical manner, even where relatively soft soil exits beneath the foundation block. This feature of the invention is especially advantageous for a relatively flat arch. Flat arches are used in conjunction with wide clearances with a minimum of lost height LH (FIGS. 1A, 1B and 2).

Figure 2:
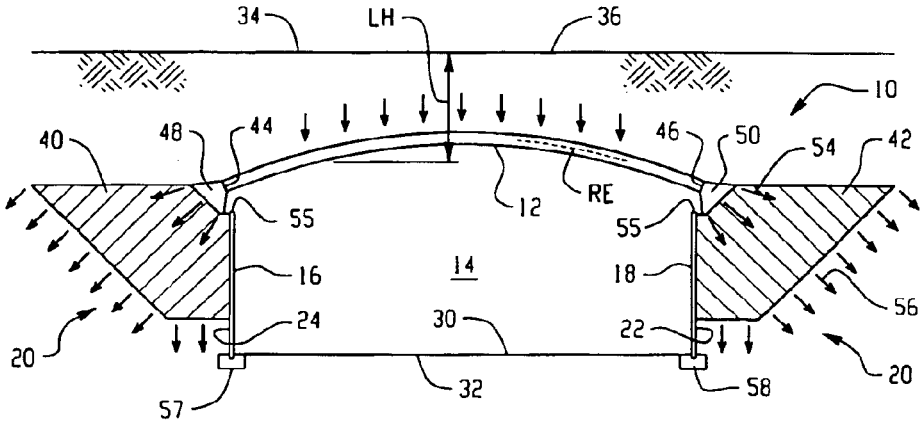
FIG. 2 shows the typical cross section for the basic embodiment of the present invention using a flat arch resting on foundation blocks.

Referring to FIG. 2, it can be understood that top-arch arched overfilled and/or backfilled structure 10, which also will be referred to as an arch structure, and method of construction embodying the present invention includes an arch span 12, which also will be referred to as an arch element, or simply an arch, which forms the roof of a void 14 within an earth filled space. Beneath arch span 12, walls 16 and 18, which will also be referred to as side walls or retaining walls, retain backfilled earth 20 or excavation edges 22 and 24 of previously existing (in situ) ground material on either side of open space 14. The arch and retaining walls may or may not be structurally connected. The art and practice of the present invention enables the arch and the walls to be constructed independently, in different construction phases. The purpose and form of the arch, the retaining walls and the means of founding these two key components of the backfilled and/or overfilled structure will be understood from the teaching of the present disclosure.

Structure 10 can be located between first selected area 30 which can be the floor of a void or a lower pathway, and which includes a plane 32, and a second selected area 34 which can be a roof of a void or an upper pathway which includes a plane 36. The arch span comprises reinforced or unreinforced concrete, which may be manufactured as precast elements or cast in place or a combination of these means.

The arch span is founded via arch footings and foundation blocks 40 and 42 on general earth backfill 20 and/or on in situ soil (the surface of the previously existing (in situ) subsoil having been excavated to that extent). Foundation blocks 40 and 42 are each placed behind corresponding sidewalls 16 and 18 respectively of the overfilled and/or backfilled arch structure during its construction. Arch footings 48 and 50, formed of concrete or reinforced concrete are interposed between springs 44 and 46 which will also be referred to as ends of arch span 12 and the foundation blocks to further distribute forces over a wide area as indicated by arrows 54 thus also reducing the strength and stiffness requirements of the solidified fill material. As can be understood from the figures, especially FIG. 2, forces 54 are radially directed forces associated with the springs of the arch span. As can be understood from FIG. 2, the contact between the springs of arch span 12 and the foundation blocks is arranged so that forces associated with the springs of the arch are transferred via the arch footings to the foundation blocks. Accordingly, the sidewalls do not support the arch structure in any significant manner, at least not in the horizontal direction. In fact, as shown in FIG. 2, since the springs of arch span 12 are spaced apart from the top ends 55 of the sidewalls, it can be stated that all or at least most of the forces associated with the springs of the arch span are transferred to the foundation blocks. The foundation blocks comprise a solidified material exhibiting sufficient stiffness and strength such that the thrust reactions of the arch can be distributed through the foundation block to the adjacent soil material. Thus the system embodying the present invention enables three objectives to be achieved with one structural member because the foundation blocks serve both to secure the sidewalls of the structure while at the same time to provide the foundation for the arch structure and to constitute all or part of the backfill.

As indicated by arrows 56 in FIG. 2, the foundation blocks distribute the concentrated arch support forces at the springs of the arch via arch footings onto a sufficiently large earth backfill area such that the bearing pressure on the volume of earth to which the arch loads are applied does not cause unacceptable displacements, especially in the horizontal direction. Materials which may be used for creation of the foundation blocks 40 and 42 include cement stabilized earth (soil cement), lime stabilized earth, hardened flowable fill, lightweight hardened flowable fill, jet grouted earth or other such manufactured or treated material. These materials have a strength and stiffness superior to that of normal earth, but considerably less than that of standard concrete. Thus, foundation blocks 40 and 42 are much more economical to produce than standard concrete. Quite often, earth material not suitable for bridge backfilling can be used for the foundation blocks since it is treated with cement and or lime or other additions. Additionally, material that would need to be deposited in special dumps, since they are environmentally critical, may be used as backfill because when treated with cement, etc, some such materials are no longer critical or dangerous.

Figure 3:
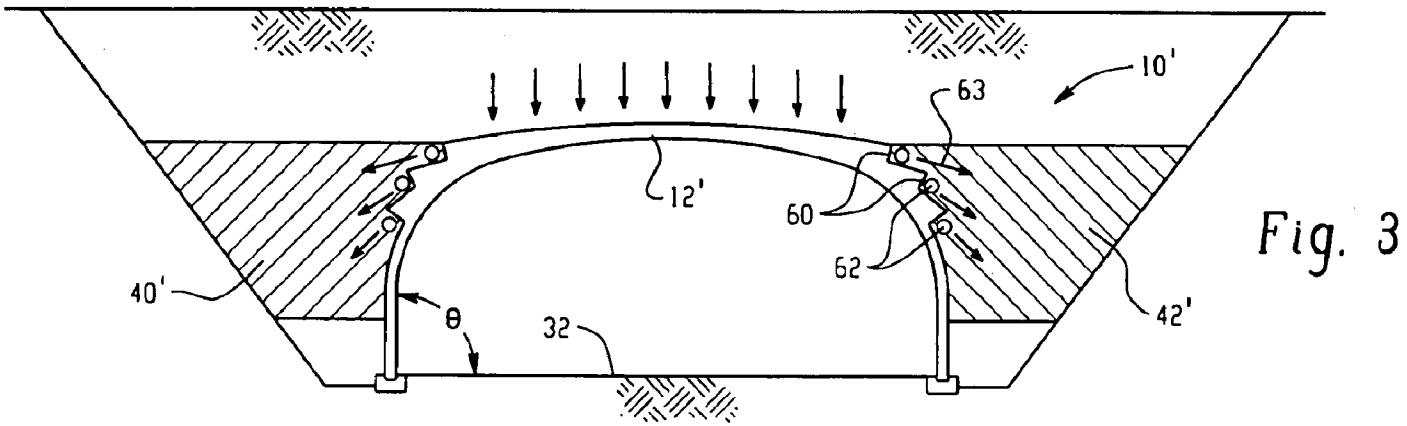
FIG. 3 shows the typical cross section for the basic embodiment of the present invention using a continuous frame supported by foundation blocks in which the arch and the sidewalls are integral and continuous, the embodiment shown includes a stepped outer surface.
Figure 4:
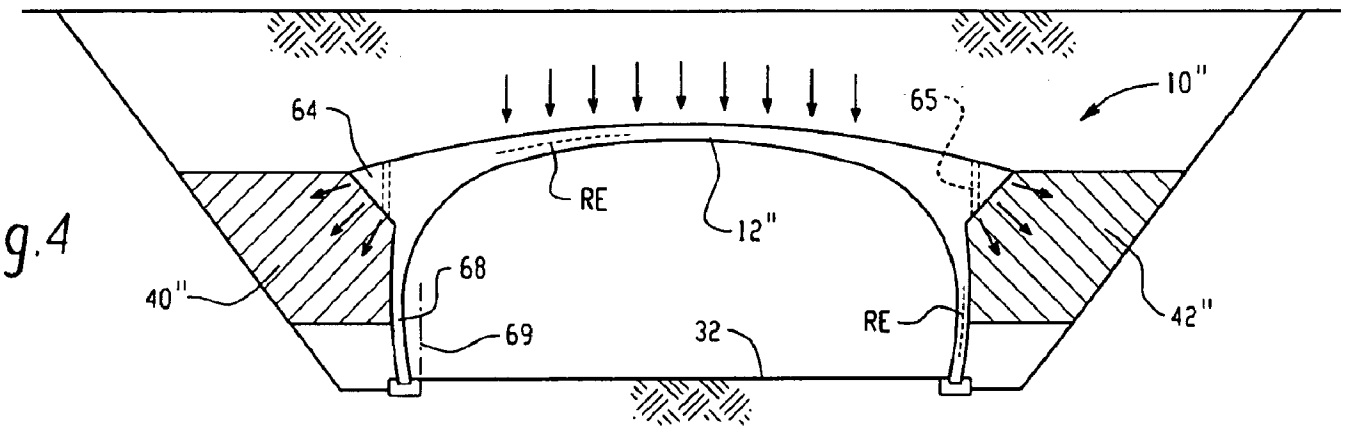
FIG. 4 shows the typical cross section for the basic embodiment of the present invention using a continuous frame supported by foundation blocks in which the arch and the sidewalls are integral and continuous, the embodiment shown includes a protruding corner.

Walls 16 and 18 may be constructed independently of, and before, arch 12 and can be designed primarily for the purpose of retaining the backfill soil placed at the outside of the backfilled structure; or as a continuation of the concrete arch span so as to be one-piece and monolithic therewith as indicated by system 10' shown in FIG. 3 or system 10" shown in FIG. 4.

Independently constructed sidewalls may comprise mechanically stabilized earth (MSE) using precast wall panels or any other type of earth retaining wall, including but not limited to sheet piles, bored piles or an excavated cast-in-place (cip), precast or sprayed (shotcrete) concrete wall with or without nails/anchors. The independence of sidewall and arch construction enables the construction process to be staged as independent activities i.e. construction of the sidewalls and solidified backfill, and subsequent placement of the arch and overfill of the structure.

Since all or at least most of the arch support forces are directed onto the foundation blocks, wall foundations 57 and 58 respectively can be designed to be very small as compared to wall foundations F1 and F2, or omitted completely.

Figure 1C:
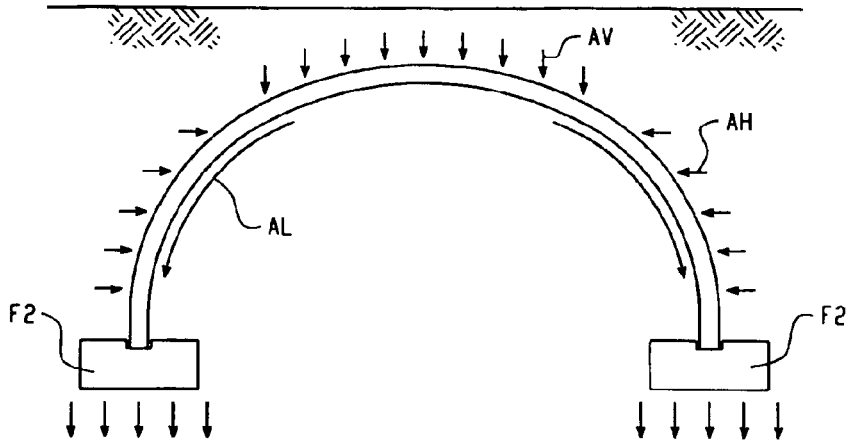
Fig. 1C (PRIOR ART)
FIG. 1C illustrates forces associated with overfilled arches, as characteristic of a prior art system.

As can be understood by comparing FIGS. 1C and 2, the system embodying the present invention has several advantages over prior art systems. By locating the foundation blocks behind the wall or walls a number of advantages become associated with the system embodying the present invention. Normal foundations below the walls, which usually require significant cuts into the ground and which can be expensive and environmentally disadvantageous especially in the case of river beds (wetlands act prohibits the interference with river beds) or when deposited wastes have to be removed prior to foundation construction, can be significantly reduced.

Since the foundation blocks of the present system are located behind the sidewalls, they are less at risk when scour problems are present, than the footings of prior art systems.

The foundation blocks of the present invention are simpler, cheaper and can be faster to build than prior art footings. An additional advantage is that general earthworks machinery may be used for their construction rather than specialist equipment used for placing concrete.

Earth material unsuitable for backfill in prior art systems can be made suitable for the system of the present invention even for the solidified backfill zones (foundation blocks), by using cement, lime or other solidifying materials and/or treatment.

The foundation blocks are unreinforced (except by anchors, mostly synthetic anchors in some forms of the invention) and therefore are more durable and longlasting compared to prior art systems. In the case of cement or lime treatments, the foundation blocks actually become harder over time; they cannot deteriorate.

Because the system of the present invention primarily uses earth material available at the site, the system of the present invention has several ecological advantages, including less transportation (less air pollution), and less exploitation of valuable gravel resources. There is even the possibility of backfilling the wall with environmentally hazardous materials which in some cases become harmless when mixed with cement, lime or other additive.

Furthermore, by comparing the system shown in FIG. 2 to the system shown in FIG. 1B, it can be understood that the system embodying the present invention has an advantageously reduced lost height LH required to achieve the same clearance profile as compared to prior art systems.

There are many alternative forms of the present invention. One form of the invention is the case where the upper pathway plane 36 (in FIG. 2) co-incides with the top surface of the arch span 12, thus omitting the earth overfill which is a normal characteristic of the present art. As mentioned above, two forms of the invention are shown in FIGS. 3 and 4 as systems 10' and 10" respectively. The flat arch form of the invention may rest on foundation blocks which simultaneously serve to support the sidewalls, or may comprise a continuous frame supported laterally by foundation blocks as shown in FIGS. 3 and 4. FIG. 3 shows system 10' which includes steps 60 in the upper sides of the arch structure 12' as well as elements 62, such as pipes or the like, which are used to grout the contact zone between the structure itself and the foundation block, thereby additionally securing the intimate contact and force transfer from the arch structure 12' of system 10' to foundation blocks 40' and 42'. Forces from arch structure 12' are distributed to the foundation blocks as above described and as identified by arrows 63. FIG. 4 shows an embodiment 10" of the flat arch using a continuous one-piece monolithic frame whereby protruding corner 64 is used instead of the stepped upper side of the arch structure 12' to ensure the force transfer from the structure to the foundation block. In order to ensure a secure connection between arch structure 12" and foundation blocks 40" and 42", a channel 65 can be defined through each protruding corner. Cement or concrete or the like can be placed through channel 65 and/or pipes can be used as in the other embodiments of the invention to improve the intimacy of the contact between protruding corner 64 and foundation blocks 40" and 42".

Also, as shown in FIGS. 2 and 3, the sidewalls of the system of the present invention can be planar and extend perpendicularly with respect to plane 32 contained in first selected area 30 or can be inclined at an oblique angle θ with respect to plane 32 with angle θ being an acute angle whereby the sidewalls incline toward each other. Furthermore, as indicated in FIG. 4, the sidewalls can be curved in the manner indicated at area 68 with respect to a plane 69 which is upright with respect to plane 32. In some cases, plane 69 can be perpendicular to plane 32. In other cases, as will be discussed below, the curved nature of the sidewall will make that sidewall cylindrical in nature.

Furthermore, any or all of the systems of the present invention can include reinforcing elements RE in either or both the arch and/or the sidewalls as indicated in FIGS. 2 and 4. The foundation block as such is unreinforced with the exception of the mostly synthetic anchors used to tie the MSE (mechanically stabilized earth) walls back into the backfill (for the case where this type of wall is used).

Figure 5:
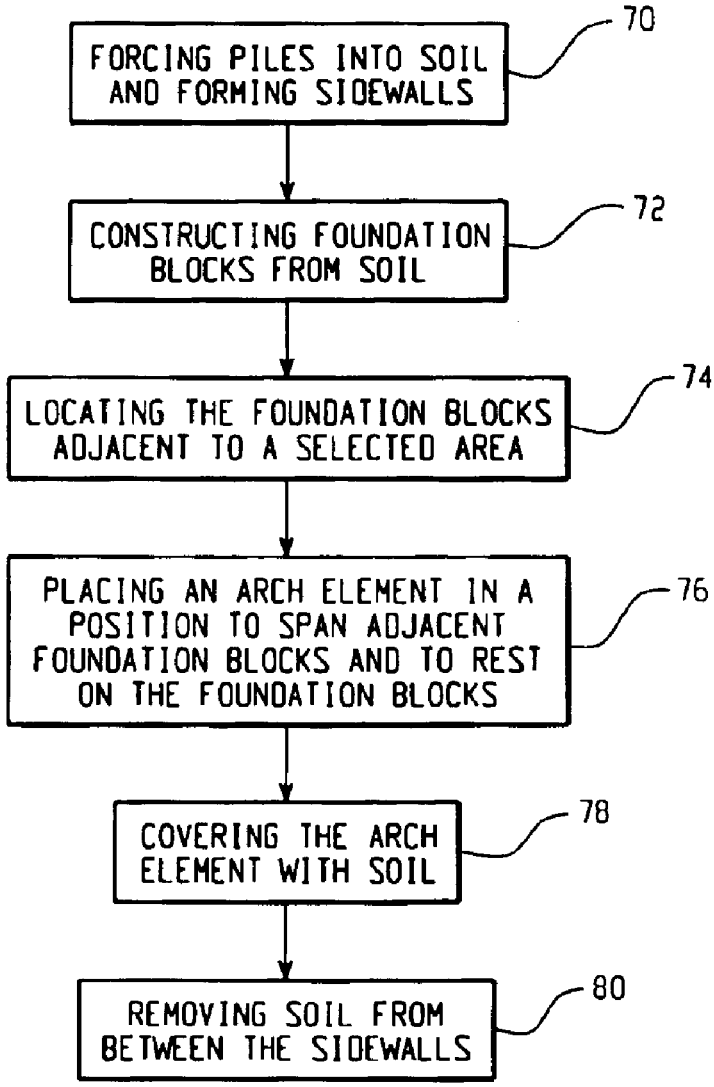
FIG. 5 is a flow chart for a cover-and-cut method embodying the present invention.

The system of the present invention can also be used in conjunction with a cover-and-cut technique. As indicated in FIG. 5, a cover-and-cut method embodying the present invention includes forming sidewalls by the use of sheet, soldier, driven or bored piles, diaphragm walls or other similar materials in step 70; constructing foundation blocks from soil in step 72; creating the foundation blocks adjacent to a selected area in step 74; placing an arch element in a position to span adjacent foundation blocks and to rest on the foundation blocks in step 76; covering the arch element with soil in step 78 (if soil cover is required); and removing soil from between the sidewalls in step 80. The final product of such a method is shown in FIG. 6 as system 90. System 90 includes sidewalls 92 and 94 which have been first constructed using sheet, soldier, driven or bored piles, diaphragm walls, etc., subsequently foundation blocks 96 and 98 are constructed by manufacturing soil cement with the excavated material or by shallow soil mixing techniques where possible or by other means of solidification; next, shallow arch span 100 is placed or constructed, and in the final step the arch is covered to natural grade 104 and the soil material 102 located between the sidewalls is removed. Where permissible, the "cover-and-cut" method can be used without first placing the sidewalls if the excavation walls can be secured using shotcrete and/or nails and anchors subsequent to and/or during removal of the material beneath the flat arch. It is noted that foundation blocks 96 and 98 can be created by excavating and replacing material with soil cement or the like, or by using a solidification process from the top such as "shallow soil mixing" or grouting or other manner to solidify the material. It is also noted that sidewalls 92 and 94 can include sheet piles, or soldier piles, or driven piles or bored piles or diaphragm walls or excavation protected by shotcrete and nails/anchors or any other practical means of creating a retaining wall appropriate for this application. As shown in FIG. 6, springs 106 and 108 of arch span 100 bear via arch footings on the foundation blocks.

Figure 7A:
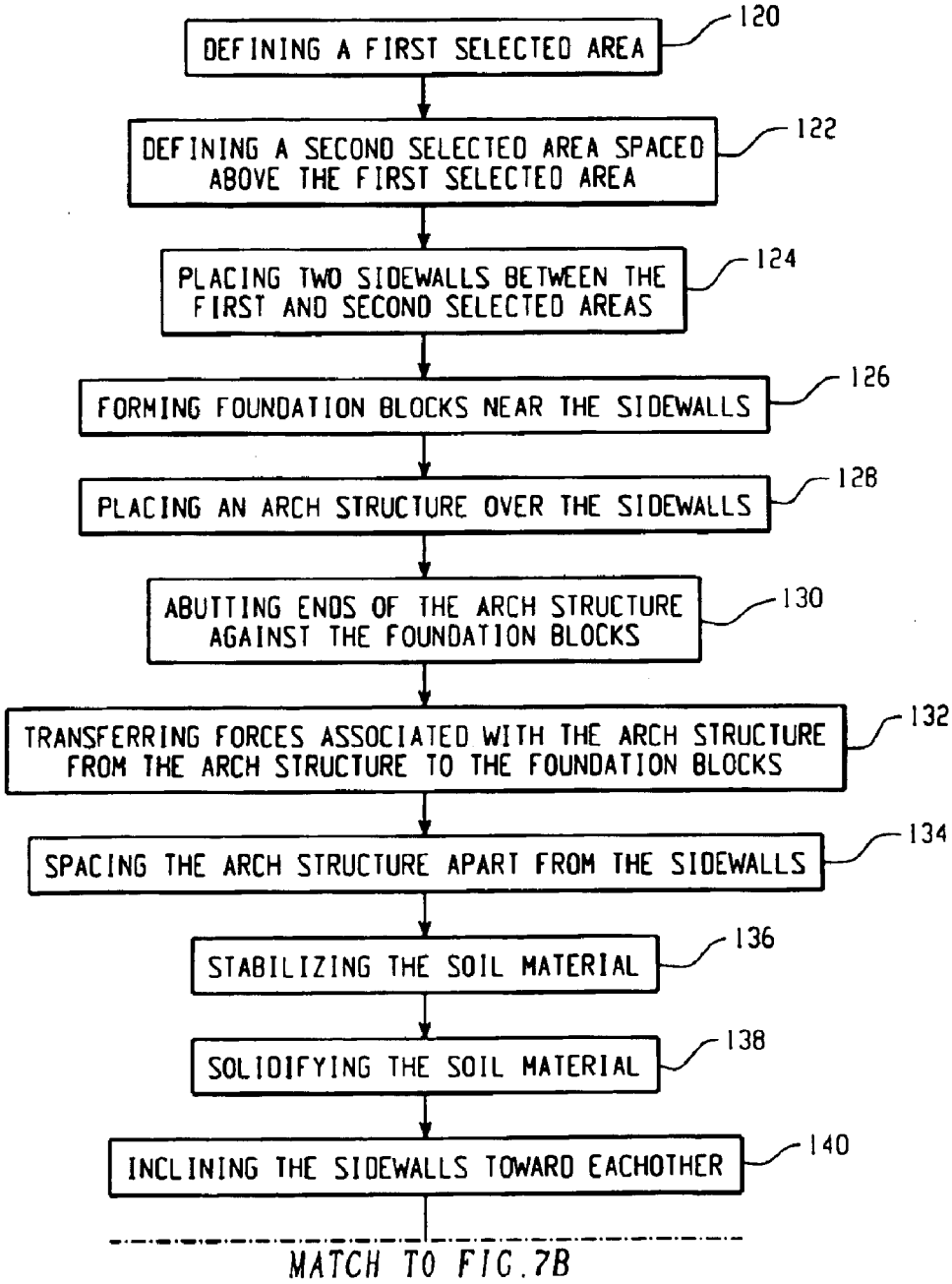
FIG. 7 is a flow chart showing the overall method of forming an arch support system embodying the present invention.
Figure 7B:
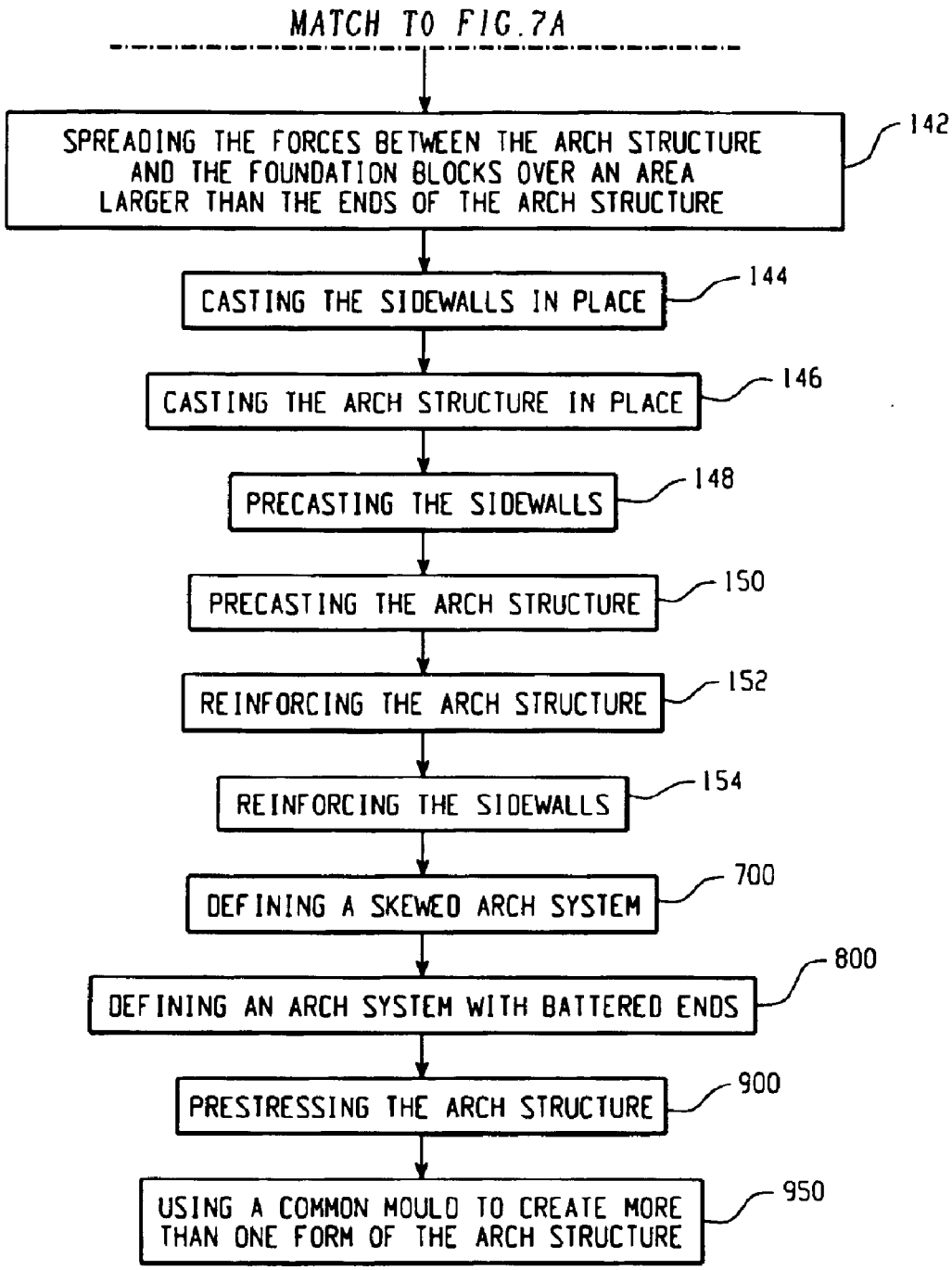

As indicated in FIG. 7, the present invention includes a method of forming an arch system which comprises defining a first selected area in step 120; defining a second selected area spaced above the first selected area in step 122; placing two sidewalls (vertical, upright or inclined) between the first and second selected areas in step 124; forming foundation blocks near the sidewalls in step 126; placing an arch span over the sidewalls in step 128; abutting ends of the arch span against the foundation blocks in step 130 (via arch footings); and transferring arch structure support forces from the arch span to the foundation blocks in step 132. The method can further include a step 134 of spacing the arch span apart from the sidewalls. The method can further include a step 136 of providing soil material near the sidewalls and the step of forming foundation blocks includes stabilizing the soil material. The step of stabilizing the soil material can also include solidifying the soil material in step 138. The method can further include inclining the sidewalls toward each other in step 140, and further include spreading the forces between the arch structure and the foundation blocks over an area larger than the ends of the arch span in step 142. As indicated in step 144, the step of placing two sidewalls can include casting the sidewalls in place, or as shown as step 146, the step of placing an arch span can include casting the arch span in place. The step of placing two sidewalls can include precasting the sidewalls in step 148, and the step of placing an arch span can include precasting the arch span in step 150. The method defined can further include reinforcing the arch span in step 152, and can further include reinforcing the sidewalls in step 154.

The above disclosure has been directed to a straight bridge structure; however, the above-disclosed means and methods can be applied to curved or angular shapes in plan view or in longitudinal section as well without departing from the scope of the present disclosure.

As discussed above, the present invention can also be embodied in a domed structure. As shown in plan view in FIG. 8, a system 10"includes a dome 160 which corresponds to arch 12 and which spans a void area therebeneath. An arcuate sidewall, which can be circular or elliptical in plan view (cylindrical) or the like identified as sidewall 161 is located beneath dome 160. A dome footing and foundation block 162 are located to abuttingly engage the spring 164 of dome 160 in the manner described above. Since the only difference between system 10"and system 10 is the dome shape of system 10", no further discussion of system 10"will be presented. It is also noted that while a spherical dome shape has been discussed, those skilled in the art will understand that the arcuate shape of the present invention can also be other arcuate shapes as well, including elliptical or other such arcuate shape. Such arcuate shapes are intended to be included in the scope of the present disclosure as well.

The dome embodiment of the present invention has an advantage that the solidified backfill (foundation block) avoids the need for circumferential tie rods (at the spring level of the dome) because of the rigidity of the foundation block.

It is also noted that the scope of the present disclosure also includes not solely bridges with pathways on top and under it, but also any kind of underground space, with one or several openings for access, exit, etc.

Still further, the system embodying the present invention can be used in connection with other forms of bridges as well, such as a multi-arch structure 200 shown in FIG. 9, a skewed arch structure 300 shown in FIG. 10 and disclosed in U.S. patent application Ser. No. 09/520,636, filed on Mar. 7, 2000 by the same inventor and titled "Overfilled, Precast Skewed Arch Bridge," the disclosure of which is fully incorporated herein by reference or an arch structure 400 shown in FIG. 11 with battered ends whereby the ends of the arch structure are sloped to match the gradient of the sides of the overfill embankment through with the arch structure passes. It is noted that systems 200, 300 and 400 all have arches, such as arches 202, 302 and 402 which abuttingly engage foundation blocks 204, 304 and 404 respectively in the manner discussed above. In the case of the multi-arch system, foundation blocks can replace the sidewalls that would otherwise be interposed between adjacent arch sections, such as indicated by foundation blocks 206. Foundation blocks 304 and 404 may be extended beyond the length of the arch elements 302 and 402. As shown in FIG. 10, skewed bridge 300 has a skew angle $\alpha$, with angle $\alpha<90°$. The methods of the present invention can be modified to include the above-mentioned arch system forms. These modifications are indicated in FIG. 7 as defining a skewed arch system in step 700 and defining an arch system with battered ends in step 800. Reference is made to the incorporated disclosure for such steps.

It is noted that the contact between the arch structures and the foundation blocks in systems 200, 300 and 400 is identical to the contact between the arch structures and the foundation blocks discussed above. Accordingly, such contact will not be discussed in detail, but reference is directed to the above discussion.

Furthermore, as indicated in FIG. 12, flat (shallow) arches 12A are susceptible to outward displacement 12A' of their springs/abutments. Therefore, the present invention contemplates prestressing the arch by pressing (jacking) the arch on one side and thus producing the opposite of what would happen if there were an outward displacement. This prestressing is indicated in FIG. 12 by arrow 12A'. The susceptibility to outward displacement, by this token, is considerably reduced. Accordingly, the method of the present invention can further include a step 900 of prestressing the arch structure.

Figure 13:
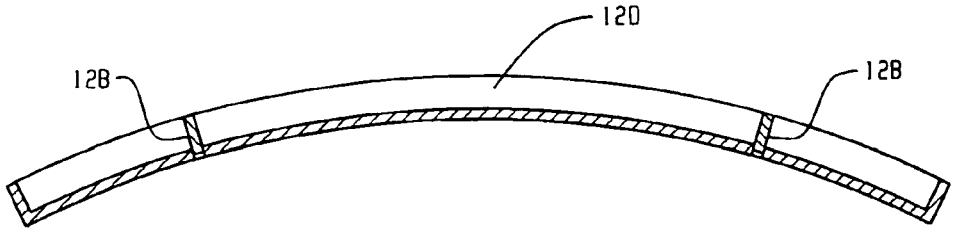
FIG. 13 illustrates a method of forming several different arch spans using the same mould or formwork, by blocking off the mold or formwork.
Figure 14:
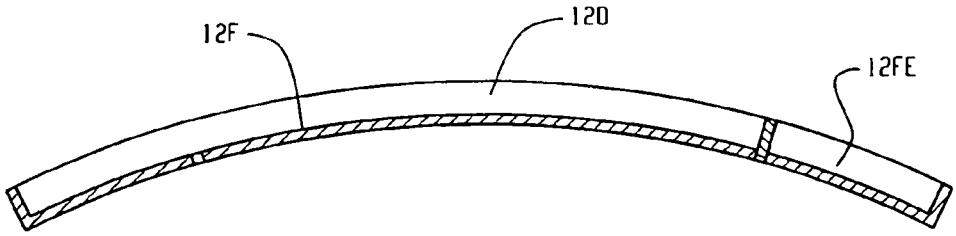
FIG. 14 illustrates a method of forming several different arch spans using the same mould or formwork by connecting extensions to the mould or formwork.

As illustrated in FIGS. 13 and 14, one of the variants of the present invention is that arch section 12D can be circular (of constant radius of curvature). Such an alternative has several advantages, including the ability to be precast in which case a single mould can be used both to form large span arches, and by blocking off part of the mould, to form smaller arch spans as indicated in FIG. 13 at areas 12B; or cast in place, in which case formwork 12F can be extended as indicated at 12FE with a circular arch shape as indicated in FIG. 14 by extension 12FE on basic formwork 12F. The method embodying the present invention can be modified to include this step as well and is indicated in FIG. 7 by step 950 of using a common mould to create more than one form of the arch structure.

It is understood that while certain forms of the invention have been illustrated and described herein, it is not to be limited to the specific forms or arrangements of parts described and shown.

What is claimed is:

1. A method of forming an arch system comprising:

A) placing elements into soil and forming sidewalls along a selected area;

B) constructing foundation blocks from soil;

C) locating the foundation blocks adjacent to the selected area;

D) placing an arch element in a position to span adjacent foundation blocks and to rest on the foundation blocks; and E) removing soil from between the sidewalls.

2. The method defined in claim 1 wherein step E) includes removing soil from between the sidewalls before step D).

3. A method of forming an arch system comprising:

A) defining a first selected area;

B) defining a second selected area spaced above the first selected area;

C) placing two sidewalls between the first and second selected areas;

D) using soil, forming foundation blocks near and behind the sidewalls;

E) placing an arch structure over the sidewalls;

F) abutting ends of the arch structure against the foundation blocks; and

G) transferring arch support forces from the arch structure to the foundation blocks via small arch footings.

4. The method defined in claim 3 further including a step of spacing the arch structure apart from the sidewalls.

5. The method defined in claim 3 further including a step providing soil material near the sidewalls and the step of forming foundation blocks includes stabilizing the soil material.

6. The method defined in claim 5 wherein the step of stabilizing the soil material includes solidifying the soil material.

7. The method defined in claim 3 further including inclining the sidewalls toward each other.

8. The method defined in claim 3 wherein the sidewalls are formed of reinforced concrete.

9. The method defined in claim 3 wherein the step of placing two sidewalls includes casting the sidewalls in place.

10. The method defined in claim 9 wherein the step of placing an arch structure includes casting the arch structure in place.

11. The method defined in claim 3 wherein the step of placing two sidewalls includes precasting the sidewalls.

12. The method defined in claim 11 wherein the step of placing an arch structure includes precasting the arch structure.

13. The method defined in claim 3 further including using reinforced concrete for the arch structure.

14. The method defined in claim 3 further including using reinforced concrete for the sidewalls.

15. The method defined in claim 3 further including forming a skewed arch structure.

16. The method defined in claim 3 wherein said arch structure and said sidewalls define an arch system with battered ends.

17. The method defined in claim 3 further including a step of prestressing the arch structure by moving at least one end of the arch toward the center of the span.

18. The method defined in claim 1 further including a step of overfilling the arch element.

19. The method defined in claim 5 wherein the soil material is fill material.

20. The method defined in claim 5 wherein the soil material is in situ material.

21. The method defined in claim 6 wherein the soil material is fill material.

22. The method defined in claim 6 wherein the soil material is in situ material.

23. A method of forming an overfilled bridge structure, comprising:

A) defining a first selected area;

B) defining a second selected area spaced above the first selected area;

C) placing a first sidewall at one edge of the first selected area and a second sidewall at another edge of the first selected area;

D) using soil, forming a first foundation block near and behind the first sidewall and forming a second foundation block near and behind the second sidewall;

E) placing an arch structure over the sidewalls;

F) abutting a first end of the arch structure against the first foundation block and a second end of the arch structure against the second foundation block; and G) overfilling the arch structure with material;

wherein arch support forces are transferred from the arch structure to the first and second foundation blocks.

24. The method defined in claim 23 wherein a top part of the first foundation block is located higher than a bottom of the first sidewall and a top part of the second foundation block is located higher than a bottom of the second sidewall.

25. A method of forming an overfilled bridge structure, comprising:

A) defining a void area location with first and second edges;

B) defining a first foundation block location outside the void area location and a second foundation block location outside the void area location;

C) placing a first sidewall at the first edge of the void area location and a second sidewall at the second edge of the void area location;

D) using soil, forming a first foundation block outside the void area location and forming a second foundation block outside the void area location;

E) placing an arch structure over the void area location;

F) abutting a first end of the arch structure against the first foundation block and a second end of the arch structure against the second foundation block; and G) overfilling the arch structure with material;

wherein arch support forces are transferred from the arch structure to the first and second foundation blocks.

26. The method defined by claim 25 wherein a top part of the first foundation block is located higher than a bottom of the first sidewall and a top part of the second foundation block is located higher than a bottom of the second sidewall.

27. The method defined by claim 25 wherein a location of the first foundation block is immediately behind the first sidewall and a location of the second foundation block is immediately behind the second sidewall.

* * * * *